US005260758A

United States Patent [19]

Stemmle

[11] Patent Number: 5,260,758

[45] Date of Patent: Nov. 9, 1993

[54] SIGNATURE JOB COPYING SYSTEM AND METHOD

[75] Inventor: Denis J. Stemmle, Webster, N.Y.

[73] Assignee: Xerox Corporation, Stamford, Conn.

[21] Appl. No.: 986,393

[22] Filed: Dec. 7, 1992

[51] Int. Cl.[5] ..... G03G 21/00

[52] U.S. Cl. ..... 355/321; 271/3.1; 355/25; 355/319

[58] Field of Search ..... 355/25, 133, 233, 308, 355/309, 319, 321; 271/3, 3.1, 185, 186; 358/474, 498; 270/54

[56] References Cited

U.S. PATENT DOCUMENTS

| | | | |
|---|---|---|---|
| 4,184,671 | 1/1980 | Sasamori | 355/319 X |
| 4,592,651 | 6/1986 | Oikawa et al. | 355/319 X |
| 4,595,187 | 6/1986 | Bober | 270/37 |
| 4,708,469 | 11/1987 | Bober et al. | 355/308 X |
| 4,727,401 | 2/1988 | Partilla et al. | 355/319 |
| 4,727,402 | 2/1988 | Smith | 355/319 |
| 4,814,822 | 3/1989 | Acquaviva et al. | 355/133 |
| 4,925,176 | 5/1990 | Acquaviva | 355/318 X |

*Primary Examiner*—A. T. Grimley
*Assistant Examiner*—William J. Royer
*Attorney, Agent, or Firm*—Oliff & Berridge

[57] ABSTRACT

An automatic document feeder having top and bottom sheet feeders for selectively feeding top and bottom document sheets from the top and bottom of a stack of documents placed in an input tray of the document feeder is used to feed documents onto a copier platen in proper signature page order. The automatic document feeder selectively feeds the documents in accordance with a signature sequence by feeding a first document from either the top or from the bottom of the stack, followed by feeding alternate pairs of documents from the top and from the bottom of the stack, starting with an opposite one of the top and bottom of the stack from the one containing the first document, until all documents are fed to the copier platen. The documents are moved two at a time as a signature document pair in the signature sequence directly from the automatic document feeder to the imaging station. Preferably, the documents are fed long-edge-first onto the copier platen while the signature copy sheets which receive page images from the signature document pairs are fed short-edge-first through a duplex paper path of the copier. When the collated stack of documents is arranged face-up in the automatic document feeder, with page one on top of the stack, feeding occurs in the following sequence, wherein T represents a sheet fed from the top of the document stack and B represents a sheet fed from the bottom of the document stack: T,B B, T T, B B, T . . .

23 Claims, 6 Drawing Sheets

SIGNATURE JOB COPYING SYSTEM AND METHOD

BACKGROUND OF THE INVENTION

1. Field of the Invention

The present invention relates to apparatus and methods for forming signatures from a collated stack of documents, and more particularly to copying apparatus and methods of using copying apparatus for outputting signatures from a collated stack of documents which are placed directly in a document handler of the copying apparatus without any manual or automatic preordering of the documents, and which are fed from the document handler directly to the imaging platen of the copier for imaging.

2. Description of Related Art

A signature is a sheet containing plural (usually 4) printed pages (page images), usually two on each side, with a page arrangement such that when such signature sheets are center-folded and nested one inside of the other with other signature sheets in a set they become one collated pamphlet, booklet, or book; or a quire forming one section of a larger book. The booklet copies may be formed from center-folded sheets of paper each carrying four copy images of the original documents made in a known signature page sequence. A particular, known, non-directly-sequential placement of images on each signature sheet is essential to providing a completed signature set or booklet with a proper direct sequential page order.

It is not surprising that signature copying, even though it is a desirable function or feature, is not commonly practiced on copiers except by experienced operators, and is very error prone. With manual document handling, one slip in any of the complicated processes of document page reordering and variable orientation and sequencing of document placement and spacing will result in unusable book copies, and the job must be redone.

U.S. Pat. No. 4,708,469 to Bober et al. discloses an interactive system for signature production which responds to operator input data defining the total number of pages in a document to be signature printed by displaying the pagination of the signatures, illustrating for the operator the proper signature orientation. The system also calculates a check value for use in determining whether the correct pages have been copied onto each signature. This system requires manual placement of the original documents on the copier platen, and thus introduces the possibility of errors and also requires a great deal of time to precisely align each pair of documents on the platen.

U.S. Pat. No. 4,727,402 to Smith discloses a system for automatic signature set production in which a collated stack of documents is first placed onto an automatic document reordering and presenting system which reorders the documents into the appropriate signature order by selectively feeding the documents to one of two stacks located in a dual feeding recirculating document handler (RDH). Once the documents have been preordered into the appropriate signature order, and placed into the two stacks in the RDH, the documents are fed two at a time (i.e., a sheet is simultaneously fed from each stack in the dual feeding RDH) to the copier imaging platen for "two-up" copying onto one side of a signature copy sheet. The automatic document reordering and presenting system can include a bottom-feeding conventional RDH which requires that the collated stack of documents placed therein be recirculated therethrough in order to place the documents in the two stacks formed in the dual feeding RDH in the appropriate signature order. As an alternative, a document feeder which alternately feeds from the top and bottom of the collated stack of documents can be used in the automatic document reordering and presenting system (see FIG. 12 and column 19, lines 26–44). In either case, a separate system is required to reorder and present the documents to the dual feeding RDH which feeds to the copier platen. Additionally, because the system of U.S. Pat. No. 4,727,402 is a high speed copier in which copy sheets are fed therethrough long-edge-first, the document sheets whose images are to be copied onto one side of a signature copy sheet must be rotated 180° with respect to the document sheets whose images are to be copied onto the opposite side of the same signature sheet (see column 18, lines 36–44). Accordingly, a sheet rotator is also placed between the input tray of the automatic document reordering and presenting system and the dual feeding RDH which feeds the signature ordered documents to the copier platen.

U.S. Pat. No. 4,925,176 to Thomas Acquaviva discloses a signature job copying system in which signature ordered document sheets are fed long-edge-first from a RDH sequentially so as to be placed two-at-a-time on the copier imaging platen for copying onto a signature copy sheet which is fed short-edge-first through the copier. The system of U.S. Pat. No. 4,925,176 also requires a special reordering system (an "automatic job loading system") for reordering the documents into the appropriate order for signature copying, and for feeding the reordered documents to the copier RDH. Moreover, the operator can not place a collated stack of documents into the automatic job loading system, but must first properly orient (i.e., invert) about the lower half of the documents in the stack prior to insertion into the automatic job loading system. This inversion introduces the possibility of errors, and the determination of which documents are to be inverted is not always straight forward.

U.S. Pat. No. 4,592,651 to T. Oikawa, et al. (Ricoh) shows a copier with a duplex recirculating document handler and a center-folding book-binding device for the signature copies. Of particular interest, cols. 14–15 describe some signature copying formulas and cols. 15–16 describe document copying sequences using immediate duplexing. However, this system requires 4 copying passes for each copy sheet being signatured, and requires immediate duplex document inversion.

All references cited in this specification, and their references, are incorporated by reference herein where appropriate for appropriate teachings of additional or alternative details, features, and/or technical background.

SUMMARY OF THE INVENTION

It is an object of the present invention to provide an apparatus and method for signature printing using an automatic duplexing copier in which a collated stack of documents can be placed directly in an automatic document feeder situated on the imaging platen of the copier, and fed from the automatic document feeder directly to the copier platen without requiring any manual or automatic pre-ordering of the documents.

In order to achieve the above and other objects, and to overcome the shortcomings set forth above, an automatic document feeder having top and bottom sheet feeders for selectively feeding top and bottom document sheets from the top and bottom of a stack of documents placed in an input tray of the document feeder is used to feed documents onto the copier platen in proper signature page order. The automatic document feeder selectively feeds the documents in accordance with a signature sequence by feeding a first document from either the top or from the bottom of the stack, followed by feeding alternate pairs of documents from the top and from the bottom of the stack, starting with an opposite one of the top and bottom of the stack from the one containing the first document, until all documents are fed to the copier platen. The documents are moved two at a time as a signature document pair in the signature sequence directly from the automatic document feeder to the imaging station. Preferably, the documents are moved long-edge-first onto the copier platen while the signature copy sheets which receive page images from the signature document pairs are moved short-edge-first through a duplex paper path of the copier.

When the collated stack of documents is arranged face-up in the automatic document feeder, with page one on the top of the stack, feeding occurs in the following sequence, wherein T represents a sheet fed from the top of the document stack and B stands for a sheet fed from the bottom of the document stack: T,B, B,T T,B B,T . . .

The resulting copy set is a true signature in properly collated order.

After imaging occurs at the copier platen, each signature document pair is fed from the platen to, for example, an output tray. After the documents are fed from the input tray over the platen, imaged and fed to the output tray, the resulting stack in the output tray is in proper signature page order. Accordingly, the signature page ordered stack of documents can be removed from the output tray and then recirculated multiple times using a conventional RDH to provide multiple signature copy sets. Alternatively, the signature page ordered stack of documents can be manually loaded into the input tray, and refed (without special sequencing) to make additional signature copy sets.

BRIEF DESCRIPTION OF THE DRAWINGS

The invention will be described in detail with reference to the following drawings in which like reference numerals refer to like elements and wherein.

DETAILED DESCRIPTION OF PREFERRED EMBODIMENTS

Figure 1:
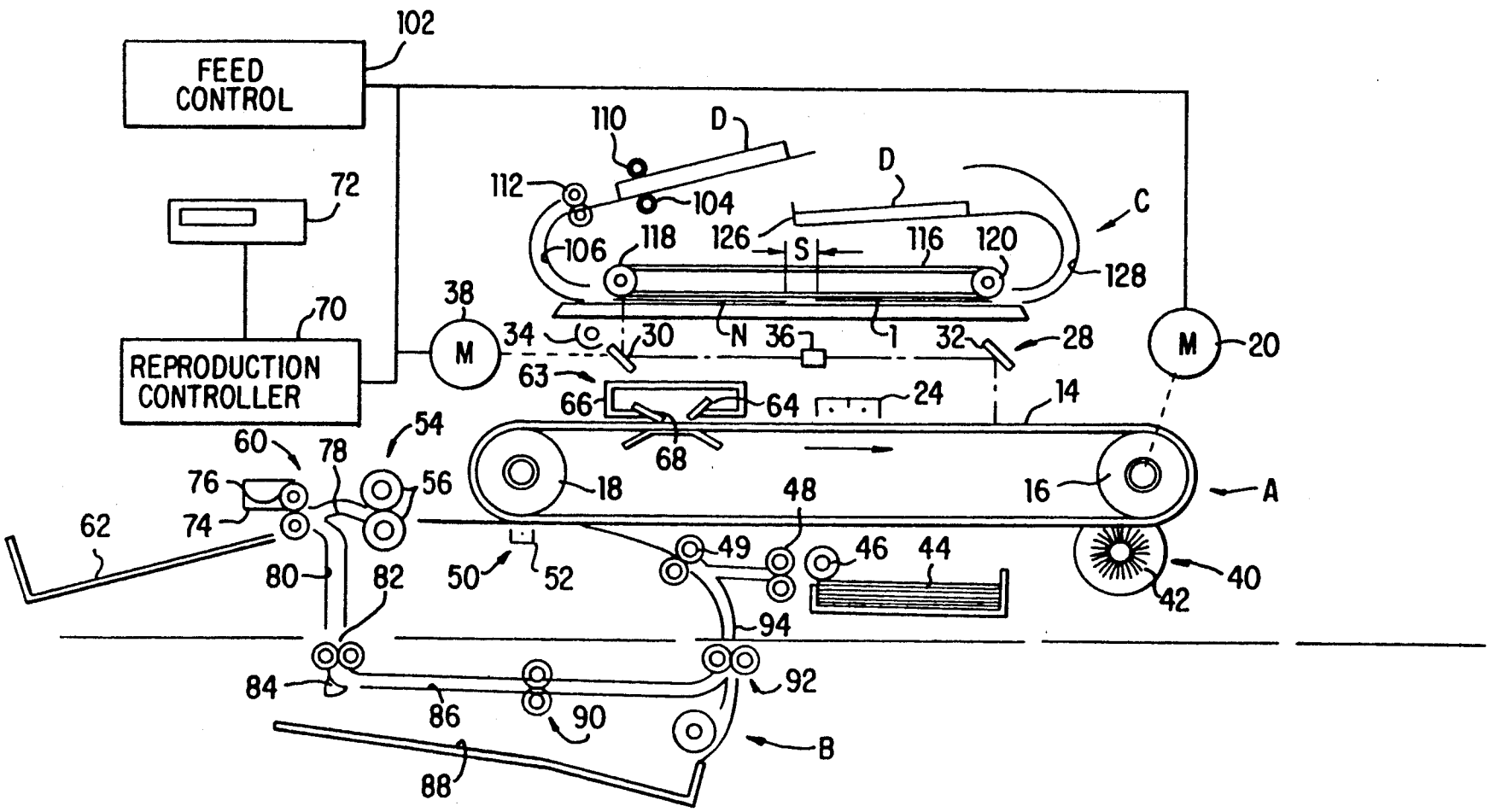
FIG. 1 is a somewhat schematic view of the copy sheet and document paths of a copier with which the present invention may be practiced.

There is disclosed herein a simplified system and method of signature printing signature sets automatically, usable with commercially available copiers with, for example, document handlers (DH's) having top and bottom sheet feeders and, preferably a separate output tray.

These and other features listed herein, or otherwise provided, may be provided in combination with one another.

The specific examples provided hereinbelow are for desirably making signatures in copiers which feed large copy sheets lengthwise, or short edge first, through the copier processor paper path. That is, the present invention provides proper document copying sequences for second pass (second side) copy feed sequences for properly signature duplexing short-edge-first oriented copy paper and in particular, for doing so with large but standard A3 size or 11×17 inch copy sheets. However, features of the systems disclosed herein alternatively may be used for signature printing conventional smaller copy sheets fed short edge first, with or without optical reduction of the document images being copied.

As noted in the cited patent literature, signature copying, i.e., imaging non-consecutively numbered originals two-up onto each side of a large copy sheet, is a complex task for a document handling system. It normally involves a great deal of manual and mental operator assistance for prearranging the originals in the correct sequence. For using an RDH to make multiple precollated signature sets, some systems (e.g., the system of U.S. Pat. No. 4,727,402) may also require a special RDH which can feed two normal size originals to the imaging station side by side (short-edge-first), and image both of them onto a wide copy sheet (fed long-edge-first).

The system disclosed herein automates the entire signature generating sequence. It does not require a special or unconventional RDH which must feed originals side by side. The present invention also does not require a document reordering and presenting system. Yet this system desirably provides efficient 2-up copying in which pairs of original images are simultaneously copied onto one side of a copy sheet at a time, in the correct image orders to provide multiple precollated signature sets.

"Two-up" copying normally means that two (or more) document sheets or pages are placed on the same imaging station at one time, normally for the copying of both onto a single copy sheet. See, for example, U.S. Pat. No. 4,814,822 to Thomas Acquaviva et al. The copy sheet can be cut into two sheets, or center-folded. If both sides are appropriately copied before folding (with another, appropriate, document image pair printed on the other side), then "signature" sheets can be produced.

In this way, for example, as noted above, two conventional size documents can be directly imaged side-by-side on one large size copy sheet, or the images on the documents can be optically reduced 0.64 times and placed on one conventional size copy sheet. For example, two B5 size document images can be placed on one B4 size copy sheet. If originals are imaged in proper signature sequence, then signatures can be made automatically, using the duplex mode of the copier, e.g., in the same basic manner as taught by the above-cited U.S. Pat. Nos. 4,727,402 and 4,925,176 but even more simply.

The present system allows and encourages casual operator signature printing, or other "two-up" copying operations, by eliminating the difficulty and complexity of proper manual page placements, page spacing and page orientation, etc., of the original document pairs.

The present system is usable with various document handlers, e.g., RDH, ADF and/or ADH systems, but especially ADH units having upper and lower sheet feeders for feeding sheets from the top and from the bottom of a stack. The present system can be desirably used for signature printing with conventional duplex precollation or postcollation copiers in which one or more sets of copies are temporarily stored in a duplexing buffer tray between their first and second side printing. Or it can be used with an immediate duplexing copier in which each copy sheet is printed on its second side immediately after its first side is printed. The (partially different) opposite side signature copying sequences for providing both modes are disclosed herein.

Some examples of art on duplex tray duplexing precollation include Xerox Corporation U.S. Pat. Nos. 4,330,197 to Smith et al.; 4,278,344 to Sahay; 4,782,363 to Britt et al.; and art cited therein. Prior art on trayless immediate or semi-immediate duplexing loops for duplexing copy sheets includes Xerox Corporation U.S. Pat. No. 4,035,073 to George DelVecchio; Kodak U.S. Pat. No. 4,264,183 to M. Stoudt; U.S. Pat. No. 4,453,819 to K. Wada et al. (Minolta); and particularly, Xerox U.S. Pat. No. 4,660,963 to D. J. Stemmle, and art cited therein. Art of particular interest as showing copiers with a choice or selection of trayless versus duplex tray duplex paths includes Xerox Corporation U.S. Pat. No. 4,660,963 to D. Stemmle and Cannon U.S. Pat. No. 4,777,498 to T. Kasamura et al. (noting especially the FIGS. 3 or 7 embodiments).

It is important to keep in mind the important known differences between precollation and post-collation copying in automatically making plural collated sets of copies of a set of documents. Precollation copying does not require a sorter or collator, merely an output set stacker and/or finisher. However, precollation with physical documents requires a recirculating document handler (RDH) to plurally recirculate the document set, since only one (or two) copy sets are normally produced per circulation. In post-collation copying plural sequential copies can be made of each document or 2-up document pair in a single presentation to the copying station, but then sorting (collation) of the output copies is required. Duplexing requirements likewise differ between the two copying systems.

Since the exemplary embodiment shown and disclosed herein has utility for use with an integral modular folder/fastener unit for making finished booklets from the collated signature sets output by the copier, reference is made to U.S. Pat. No. 4,595,187 to H. T. Bober, which discloses an on-line saddle fastening accessory with a roof-shaped compiler and means for saddle-fastening each compiled booklet, for a collated output copier with an RDH. Other signature binders are well known in the printing arts, e.g. U.S. Pat. Nos. 3,554,531 and 4,478,398 to W. J. Stobb. U.S. Pat. No. 4,416,046 to R. E. Stokes, discloses a stitcher and indicates in col. 1, line 9 that it may be used for binding signatures. Post-collation finishing can also be provided, e.g., in-bin stapling, which is known in the art for regular edge stapling.

The present system is particularly suitable for copiers with a platen and copy sheet processing path to accommodate copying of an A4 size document sheet on the platen, preferably fed long-edge-first sequentially, and to allow two of them to be copied onto a single large size copy sheet, such as A3 size, preferably fed short-edge-first. A single A3 size copy sheet has the same area as two side-by-side A4 sheets, so that when the A3 sheets are center-folded they can be made into a booklet of 4 pages A4 size if it is signature printed. Also, A3 sheets can be fed short-edge-first through a copier processor designed for long-edge-first feeding of regular copy sheets. An ISO standard A3 sheet is approximately 29.7 cm., by 42 cm. or 11.69×16.54 inches. An A4 sheet is approximately 21 cm. by 29.7 cm., or 8.27×11.69 inches, which is close to the U.S. standard "letter size" (8.5×11 inches or 21.6×27.9 cm.). See, e.g., U.S. Pat. No. 4,298,277, for the col. 14 table of standard sheet sizes.

Copiers can provide large copy sheet copying with on-line folding. The Xerox "1055" copier and the Canon NP-8570 copier, for example, provide both copying and automatic on-line folding of 28 cm. by 43 cm. (11×17 inch) copy sheets. (This is a standard size of sheet which can be signature printed and center-folded into U.S. "letter" page size booklets.)

The terms document, document sheet, or original, are used basically interchangeably in the descriptions herein, as referring to real conventional, physical, flimsy image bearing or blank sheets of paper or the like which are to be copied. Likewise, the page or sheet numbers respectively illustrated on one side of each document sheet here are not necessarily physical page numbers, they are explanatory visualizations of page order or count indicators. Obviously, for example, a quire will normally start with a page number different from one, and varying depending on the position of that quire in the final complete book of plural quires.

Referring now to the drawings, wherein the showings are for the purpose of illustrating a preferred embodiment of the invention and not for the purpose of limiting same, FIG. 1 shows a small copier system with which the present invention may have advantageous use. FIG. 1 shows the paper and copy sheet paths and operational stations of a somewhat standard reproduction processor A, in conjunction with duplex module B, and document feeder C. The reproducing machine depicted in FIG. 1 illustrates the various components utilized therein for presenting original documents and producing copies therefrom. It should become evident from the following description that the invention described herein is equally well suited for use in a wide variety of processing systems including other reproduction systems of any size, and is not necessarily limited in application to the particular embodiment or embodiments shown herein.

Reproduction processor A, illustrated in FIG. 1, includes a belt like photoreceptor member 14, the outer periphery of which is coated with a suitable photoconductive material. Belt 14 is mounted for movement about driven transport rolls 16 and 18, and travels in the direction indicated by the arrow on the inner run of the belt 14 to bring the image bearing surface thereon past the plurality of conventional xerographic processing stations. Suitable drive means such as motor 20 are provided to power and coordinate the motion of the various cooperating machine components whereby a faithful reproduction of the original input image information is recorded upon copy sheets such as a paper or the like.

Initially, photoreceptor 14 is passed through a charging station wherein photoreceptor 14 is uniformly charged with an electrostatic charge placed on the photoconductive surface by charge corotron 24 in a known manner preparatory to imaging. Thereafter photoreceptor 14 is exposed to the light from the input image (or images when signature printing) whereby the charge is selectively dissipated in the light exposed regions to record the input image in the form of an electrostatic latent image. A document or documents D supported on platen 27 is scanned with a multi-mirror scanning optics system 28 schematically represented by the mirrors 30, 32, lamp 34 and lens 36 supported on carriages (not shown) and driven by servo motor 38 for controlled scanning movement. Multi-mirror scanning optics system 28 may typically be a 4 or 6 mirror arrangement of a type well known in the art, and providing controlled scanning of portions of platen 27 and accordingly, selectable scanning of documents placed thereon. Subsequent to imaging, the photoreceptor 14 passes through development station 40. A suitable development station could include a magnetic brush development system, including developer roll 42, utilizing a magnetizable developer mix having coarse magnetic carrier granules and toner colorant particles.

Blank copy sheets, which may be paper, plastic, etc. as desired, are supported in a stacked arrangement on elevated stack support tray 44. With the stack at its elevated position, the sheet separator segmented feed roll 46 feeds individual sheets therefrom to the registration pinch roll pair 48. The sheet is then forwarded through nip roll pair 49 to transfer station 50 in proper registration with the image(s) on the belt 14, and the developed image on the photoconductive surface is brought into contact with copy sheet within the transfer station 50, and the toner image is transferred from the photoconductive surface of the photoreceptor belt 14 to the contacting side of the copy sheet by means of transfer corotron 52. Following transfer of the image, the copy sheet is separated from photoreceptor 14 by the beam strength of the copy sheet as it passes around the curved face of photoreceptor 14 around the transport roller 18; and the copy sheet supporting the toner image thereon is advanced through fixing station 54 wherein the transferred powder image is affixed to the copy sheet by passing the copy sheet through heated fuser roller nip 56. After fusing the toner image to the copy sheet, it is advanced to the reversible exit nip 60 from where it may be directed to sheet stacking tray 62, the input of a sorter, or to a finishing device or directed to duplex module B (e.g., when signature printing).

Although a preponderance of toner is transferred to the copy sheet, invariably some residual toner remains on the photoconductive surface of the photoreceptor belt 14 after the transfer of the toner image to the final support material or copy sheet. The residual toner particles remaining on the photoconductive surface after the transfer operation are removed from the belt 14 by the cleaning station 63 which comprises, for example, a cleaning blade 64 in scraping contact with the outer periphery of the belt 14, and contained within cleaning housing 66 which has a cleaning seal 68 associated with the upstream opening of the cleaning housing. Alternatively, the toner particles may be mechanically cleaned from the photoconductive surface by a cleaning brush as is well known in the art.

When the copier is operated in the manual mode, original documents D to be reproduced are placed on platen 27 and scanned by multi-mirror scanning optics 28 which directs light from the document to the photoreceptor 14 for copying. The speed of photoreceptor 14 and scanning optics 28 are synchronized to provide for accurate reproduction of the document. Platen 27 is preferably large enough to support at least two $8\frac{1}{2}\times 11$ inch documents disposed on the platen with their long edges adjacent in spaced side-by-side relationship, and perpendicular to the plane of FIG. 1. Servo motor 38 drives scanning optics 28 in its motion by platen 27 and is controllable by reproduction processor controller 70 to selectively scan platen 27, whereby only a portion of the platen or a selected document on the platen is copied, or to scan the entire platen 27 during signature printing so that the images on both sheets located on platen 27 are copied onto a copy sheet (e.g., on an A3 size or on an $11\times 17$ inch sheet fed short-edge-first). Additionally, while in normal copying operation scanning optics 28 are moved along a path from a home position to a position required to complete exposure of a document (or documents) to be copied, servo motor 38 is also controllable to provide repeated copying of such document(s) and returning scanning optics 28 to a "start scanning" position other than a normal home position for such copying.

Reproduction processor controller 70 is preferably a known programmable controller or combination of controllers, which conventionally controls all of the other machine steps and functions described herein and including the operation of the document feeder of the present invention, the paper path drives in both the reproduction processor A and duplex module B, etc. As further described herein, controller 70 also conventionally provides for storage and comparisons of counted values including copy sheets and documents, and numbers of desired copies, and control of operations selected by an operator through alphanumeric display and control 72. See, for example, U.S. Pat. No. 4,475,156 and its references.

Reversible exit nip 60 is provided with motor 74 for driving drive roller 76 in forward, reverse and stop motion. Motor 74 may advantageously be a stepper motor of the type well known in the art. Reproduction processor controller 70 instructs motor 74 to drive the drive roller 76 of exit nip 60 as required by the copying function in process. Thus, for simplex copying of a document, or completed duplex (including signature) copying, roller 76 is driven in a forward direction to drive copy sheet to output tray 62 thereby serving as an output driver. In the case where the copy sheet is required to receive a second side image for a duplex (or signature) copy, roller 76 is driven first in a forward direction until the copy sheet trail edge has cleared passive deflector 78, and subsequently in reverse direction to drive the copy sheet back into reproduction processor A to be directed to the duplex module B. The process of changing direction while the copy sheet is in exit nip 60 serves to change the trail edge of the copy sheet to the lead edge to enable inversion of the document to receive a second side copy. In certain cases, it will be desired to hold a copy sheet while the processor advances previously returned copy sheets in order to correctly time the return of all the copy sheets to processor A for receiving a second side image. In this case, roller 76 is stopped and the copy sheet is held between the rollers until a control signal is received from reproduction controller by the reversible exit nip motor 74, directing it to drive the paper in either forward or reverse motion.

Copy sheets to receive a second side image thereon are passed downwardly from the passive deflector 78 along duplex module copy sheet path 80 to duplex module entry nip 82 which pass the copy sheet into the duplex module B. On passing duplex module entry nip 82, sheets are passed to duplex deflector baffle 84. Duplex deflector baffle 84 serves to direct copy sheets to either trayless path 86 or to duplex tray 88. Documents directed to the trayless path are advanced through trayless path 86, driven by trayless path nip 90, to duplex module exit nip 92, which returns copy sheets from trayless path 86 in duplex module B to reproduction processor A. The copy sheets enter reproduction processor A at reproduction processor entry 94, and are directed to nip rolls 49. It will be appreciated that the now-inverted copy sheets are thereby returned to the original copy sheet path in reproduction processor A to receive a second side copy thereon.

It is believed that the foregoing general description is sufficient for the purposes of the present application to illustrate the general operation of an automatic xerographic copier which can embody the apparatus in accordance with the present invention. For a more detailed description of the described system, see U.S. Pat. No. 4,727,401 to Stephen R. Partilla et al., the disclosure of which is incorporated herein by reference. It will be appreciated that while the present invention finds particularly advantageous use with respect to the described arrangement, the principles of operation may be used in many other embodiments.

Figure 2:
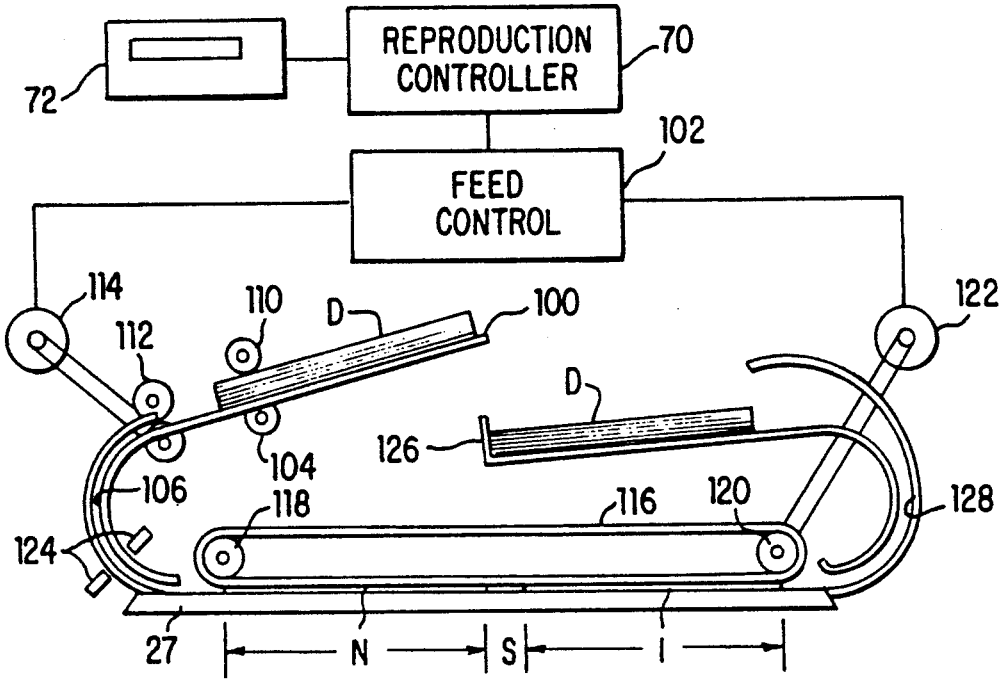
FIG. 2 is a somewhat schematic view of an automatic document feeder for use with the present invention.

Referring now to FIG. 2, which best shows a document handler in accordance with the present invention, a collated stack of simplex documents to be copied to duplex signature copy sheets are stacked in input stack tray 100. When simplex to duplex signature style copying is selected by an operator at display 72, the feed control 102 is enabled. Feed control 102 is preferably a microprocessor controller of the type well known in the art which will control operations of the document feeder in accordance with a series of predetermined steps.

Documents in the input stack tray 100 may be stacked in a face up order, with the first document in the set on top of the set and facing upwardly. The last or Nth document of the set will be the lowermost document. The input stack tray 100 is advantageously provided with a bottom retard feeder 104, well known in the art, which feeds the lowermost document out from the stack along document input path 106, while remaining documents in input stack tray 100 are held in place.

Additionally, in accordance with the present invention, the input stack tray 100 is provided with a top feeder 110 for feeding the uppermost sheet of the stack along document input path 106, while the remaining documents in the stack are held in place. This top and bottom feeding capability is advantageously used to provide for improved signature production in accordance with the present invention. For an example of a document feeder which feeds from the top or bottom of a stack, see U.S. Pat. No. 4,184,671 to Sasamori, the disclosure of which is incorporated herein by reference. As is understood (and demonstrated by U.S. Pat. No. 4,184,671), belts or rollers can be used to feed documents from the stack in tray 100. Also, as explained in the above-incorporated patent, the feeders 104, 110 can be selectively operated to feed the entire document stack from either the top or bottom as required. Unlike U.S. Pat. No. 4,184,671 (and FIG. 12 of U.S. Pat. No. 4,727,402), the present invention uses document feeders 104, 110 to alternately feed single or pairs of documents from the stack in tray 100 directly to platen 27 as will be described below.

A first document transport means is provided by locating a document feeder nip roll 112 driven by a first stepper motor 114 for engaging and advancing (i.e., moving) documents along the document input path. Document feeder nip roll 112, driven by first document feeder stepper motor 114 advances documents through document input path 106 to a second document transport means comprised of wide friction belt platen transport 116 entrained about transport rolls 118 and 120 and driven by a second document feeder stepper motor 122. First and second document feeder stepper motors 114 and 122 may advantageously be comprised of a stepper motor providing 200 steps per motor revolution, in 1.8° increments. The document feeder motors may both be driven by a common bipolar chopper drive (not shown) providing 1.5 amps per phase. Feed control 102 controls the chopper drive appropriately to operate the stepper motors. The document feeder stepper motors are controlled by a single drive to guarantee their synchronization. It will be of course appreciated that servo motors controlled in a similar manner would be acceptable for use in the document feeder.

A document sensor 124 is provided along document input path 106 to detect the passage of selected edges of documents therepast. When sensor 124 detects, for example, a document passing thereby a signal is passed to the feed controller 102 indicating passage. The feed controller 102 will then provide control signals to first and second document feeder stepper motors 114 and 122 for a selected period of time to continue driving nip roll 112 and wide friction belt platen transport 116 to advance documents a corresponding distance to copying position. On completion of copying, the reproduction controller 70 signals the feed controller 102 to advance the documents to the output and recommence feeding from the stack in accordance with the signature sequence to be described below.

When simplex to duplex signature style copying is desired, operator selection of such operation is selected at the display 72. First document (1) is fed from the top of the stack of documents in input stack tray 100 by top feeder 110 to document input path 106. First nip roll 112 advances the first document to wide friction belt platen transport 116. As the trail edge of the first document passes by sensor 124, second document feeder stepper motor 122 is enabled to drive wide belt friction transport 116 for a first selected period of time to advance the trail edge of the first document a corresponding distance to a selected position, which may be conveniently about 10 mm beyond sensor 124. The first document may be stopped at this position, which provides at least a portion of the first document in driving engagement with wide friction transport 116.

In the same manner, a second document (N) is fed from the bottom of the stack of documents in input stack tray 100 by bottom retard feeder 104 to document input path 106. First document feeder stepper motor 114 is enabled to drive nip roll 112 advancing the second document to wide friction belt platen transport 116. As the lead edge of the second document is moved past sensor 124, the first document feeder stepper motor 114 continues to drive nip roll 112 advancing the second document for a second selected period of time to advance the lead edge of the second document a corresponding distance, to a registration position with respect to the first document, thereby placing the documents in side-by-side closely spaced relationship a registration distance S apart. Second document feeder stepper motor 122 is then enabled to drive wide friction belt platen transport 116, advancing the registered documents to copying positions on platen 27 maintaining the registration distance S. In a preferred embodiment, two 8.5×11 inch documents fed long edge first (LEF) may be spaced less than approximately 2 mm apart.

As previously described, the documents are scanned by multi-mirror scanning assembly 28. In an embodiment as described by U.S. Pat. Nos. 4,727,402 or 4,925,176, the first and second documents (N and 1) are scanned. As described by the aforementioned patents, a copy sheet bearing a copy of both documents is passed through fuser 54 to reversible exit nip 60 and reversed to trayless path 86 in duplex module B, from where the first side copy sheet is returned to the reproduction processor A second side up and disposed to receive a second side copy. On receiving the second side copy on the copy sheet, the duplex signature copy sheet is passed through reversible exit nip 60 to an output, such as for example, a sorter or a folder and saddle stitcher 200.

On completion of scanning the documents, the documents are removed from the platen by enabling second document feeder stepper motor 122 to drive wide friction belt platen transport 116, advancing the closely spaced documents to an output means such as output tray 126, through document output path 128.

Figure 3:
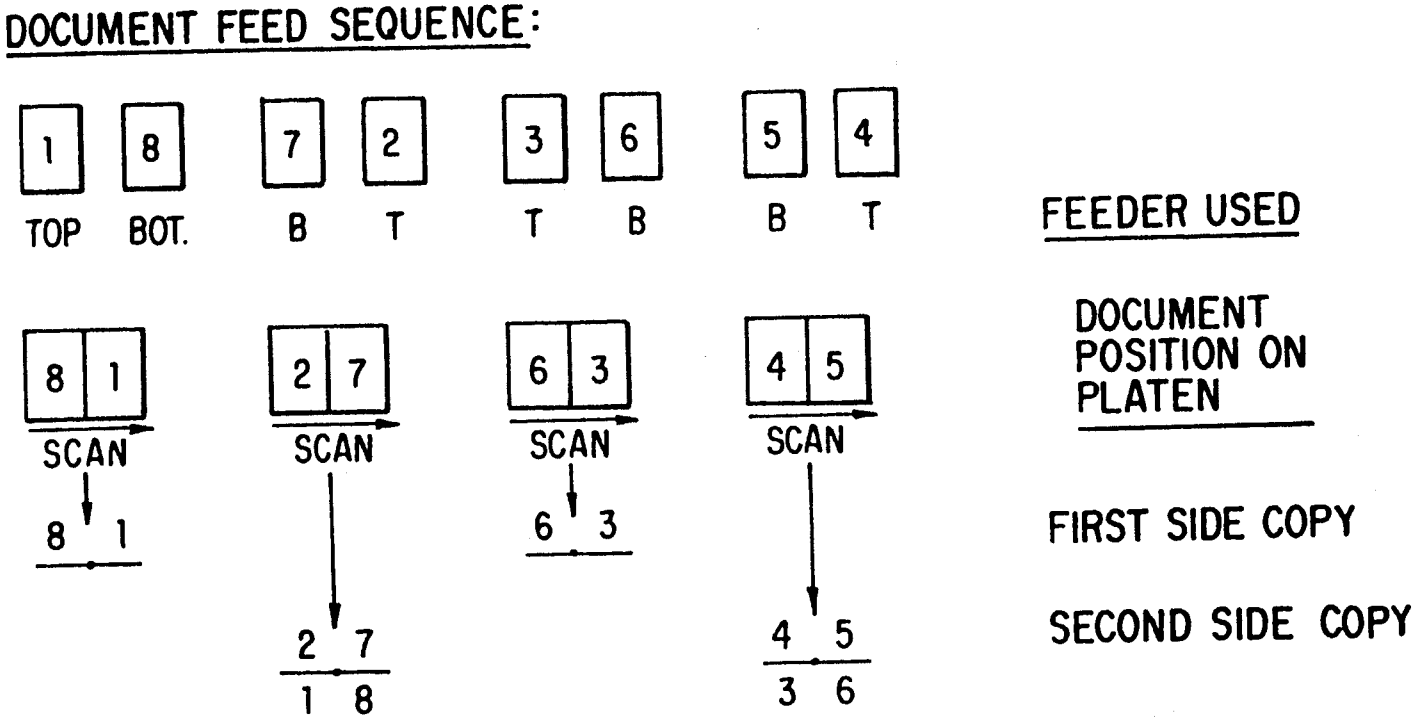
FIG. 3 illustrates the document feed sequence and copy sheet orientation and image content when the present invention is used to produce an 8 page signature booklet.

The sequence for feeding original documents D from input stack tray 100 for signature copying in accordance with the present invention will now be described. FIG. 3 illustrates a document feed sequence for feeding an eight page document from tray 100 directly onto platen 27 to form a two sheet signature copy set with four pages per sheet. FIGS. 4A–4D illustrate the positions of the documents and sheets at various stages of the signature production process. The described sequence can be used in any copier (and in particular for small copiers) capable of feeding documents long edge first from the top and bottom of a stack in an input tray and for feeding signature copy sheets short edge first through a duplex paper path loop with or without a buffer tray.

In the FIG. 3 example, the documents are arranged so as to be face-up in the input tray. First, the document containing the page 1 image is fed to platen 27 using the top feeder 110. Next, the document containing the page 8 image is fed to platen 27 by bottom feeder 104. Next, the page 1 and 8 images are copied onto one side of a signature copy sheet as described above. The copy sheet will contain the page 1 and 8 images in the orientation illustrated in FIG. 3, and will be fed through fuser nip 56 and to reversible nip 60 with the page 8 image as the leading edge of the copy sheet. However, when the copy sheet is reversed by nip 60 and fed through duplex module copy sheet path 80, the page 1 edge of the copy sheet (previously the trailing edge) becomes the leading edge. Accordingly, when the signature copy sheet containing the page 1 and 8 images is returned to transfer station 50, the page 1 image will be at the leading edge of the signature copy sheet. Accordingly, the document containing the page 2 image must be the second document to be fed to the platen 27 for "two-up" imaging so that the page 2 image will appear on the same end of the signature copy sheet as the page 1 image (although on the opposite side of the copy sheet). Accordingly, after the page 1 and 8 documents are fed from platen 27 to, for example, output tray 126, first, the document containing the page 7 image is fed onto platen 27 by bottom feeder 104, followed by the feeding of the page 2 document by top feeder 110.

Document and signature copy sheet feeding then continues as illustrated in FIG. 3 and FIGS. 4A–4D until all documents in tray 100 are copied onto the appropriate copy sheet. Thus, documents are fed in the following sequence: T,B B,T T,B B,T . . . If the stack of documents were placed face-down in tray 100, the bottom feeder 104 would feed the first sheet (page 1), with subsequent feeding proceeding by feeding alternate pairs of documents from the top and bottom feeders 110, 104, starting with the top feeder. Of course, as is known, a document sheet inverter would be required between input tray 100 and platen 27 so that the documents are placed face-down on platen 27. Such an inverter would not be required if documents fed from the input tray were not inverted by C-shaped path 106.

Unlike previous systems, original documents are fed from a collated stack placed in an automatic document feeder directly onto the copier platen for imaging. No pre-ordering is required. Additionally, none of the documents require rotation prior to imaging because the images are copied onto signature copy sheets fed short edge first. Thus, the most simple document handling possible is required by an operator using a copier in accordance with the present invention.

It is also understood that the document stack preferably should contain some multiple of 4 pages (4, 8, 12, 16, etc.) in order for the above described sequence to be followed exactly. Accordingly, prior to making signature copies, it is preferable for the user to insert any necessary number of blank documents in the stack (usually at the bottom of the stack) so that the stack contains some multiple of 4 pages. It is also possible for the control 102 to form blank pages on the signature copy sheets (e.g., by skipping the feeding of one or more documents from tray 100 while continuing to move documents over platen 27 as if a document was fed from tray 100) in order for signature copying to proceed properly. In order to determine whether blank pages need to be formed, the control 102 needs to be informed of the total number of document pages. This can be input by a user via an interface to the control, or can be determined automatically by conventional document counting procedures used in conventional RDHs. The control 102 also would have to remember where to form blank page images on the signature copy sheets (i.e., by skipping the feeding of a document from tray 100) for subsequent copy sets if more than one copy is to be formed.

Figure 4A:
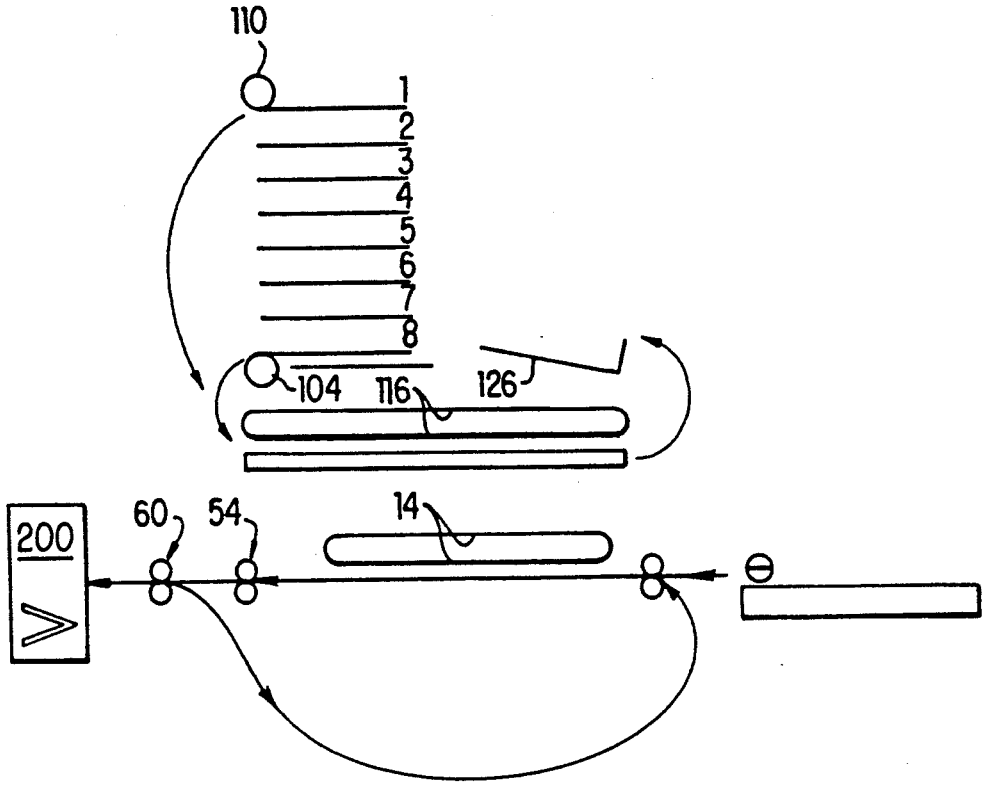
FIGS. 4A-4D illustrate the flow of document sheets and signature copy sheets through an ADF and trayless duplex loop when imaging the first six images of an eight image booklet in accordance with the present invention.
Figure 4B:
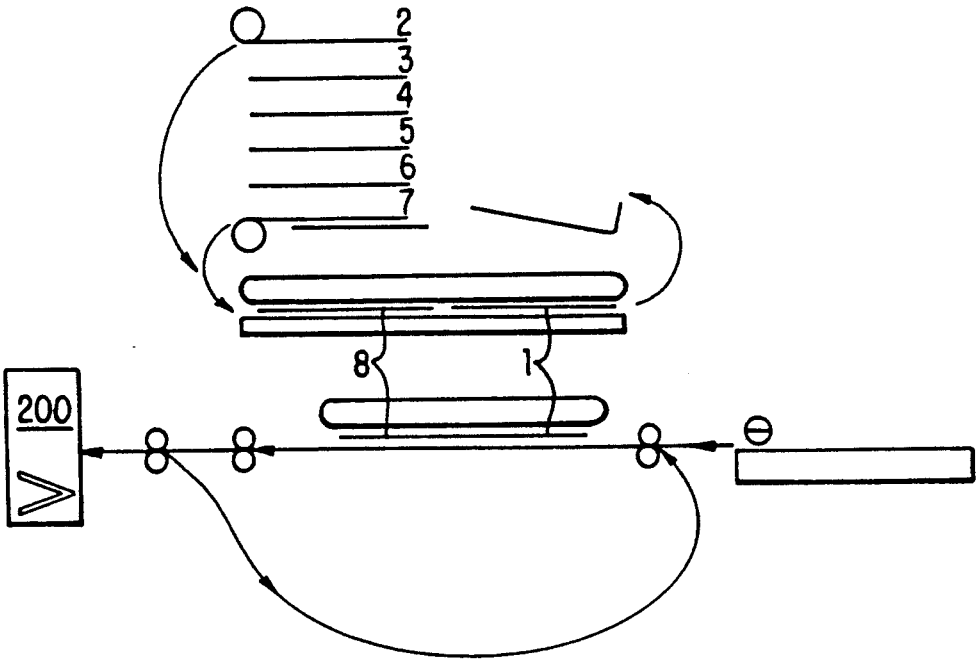
Figure 4C:
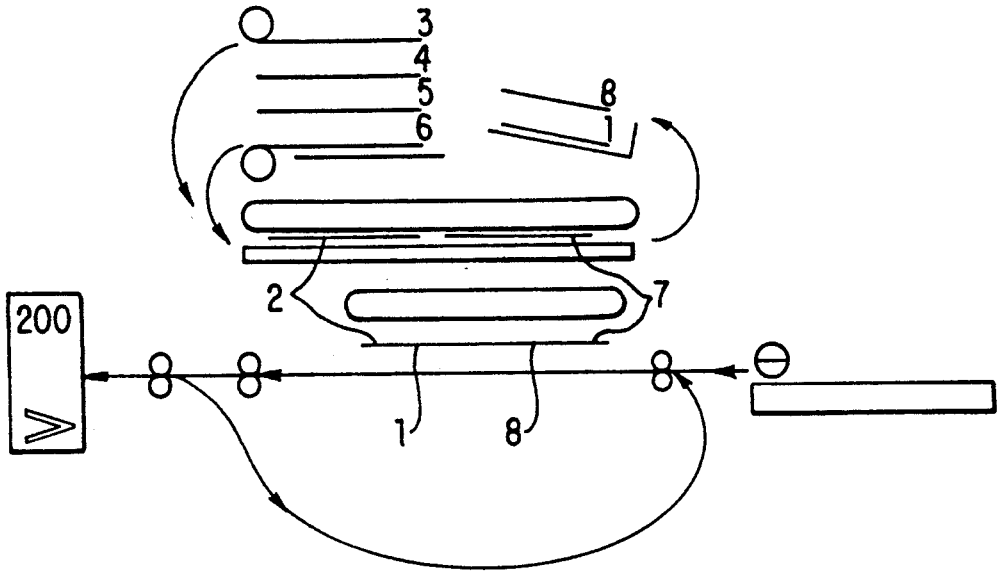
Figure 4D:
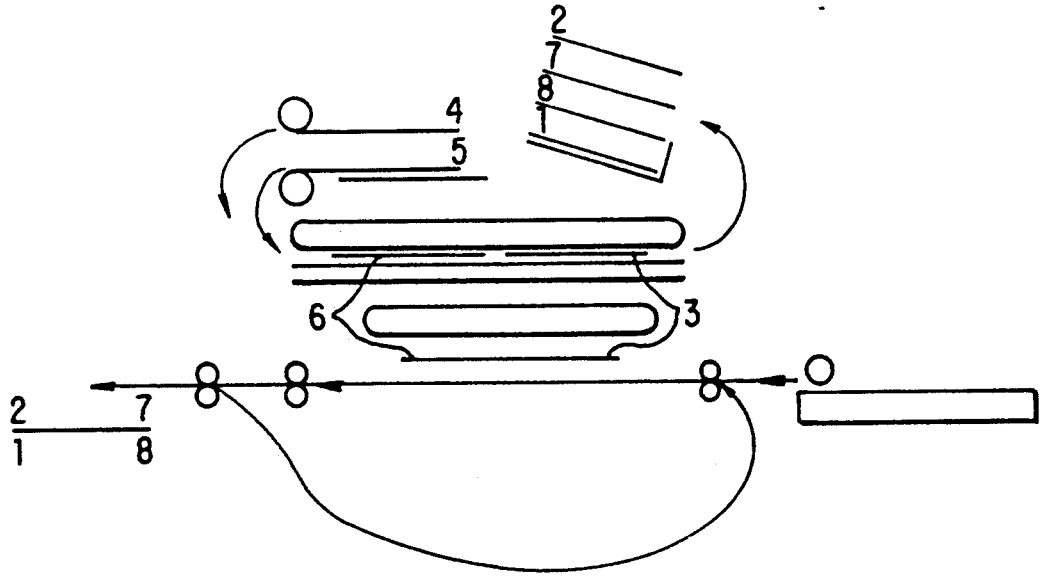

FIG. 4D also illustrates that the documents fed once from tray 100 are arranged in signature order in output tray 126. Accordingly, the stack of documents in output tray 126 can be returned to input tray 100 and fed only by bottom feeder 104 (in pairs) for subsequent signature order copying. By providing appropriate document sheet handling structure in feeder C so that the feeder can selectively operate in a single pass feeder mode (for example as described above) wherein sheets are fed to output tray 126 and stacked therein, or in a recirculating document handler mode wherein sheets fed from input tray 100 across platen 27 are returned to the top of the stack in input tray 110, a simple way of providing multiple signature copies can be provided.

Figure 5:
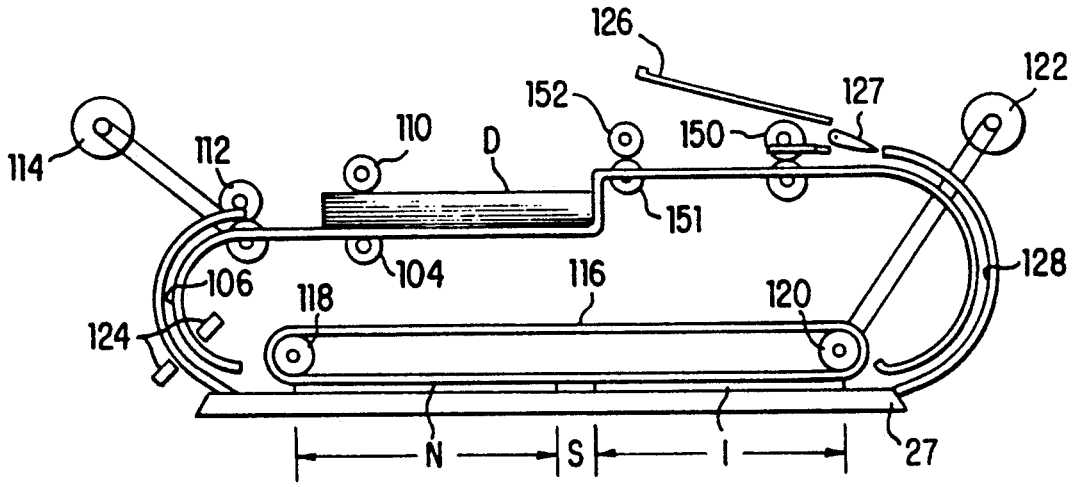
FIG. 5 is a schematic view of an alternative embodiment of the present invention wherein a modified RDH is used as the document feeder.

For example, in another alternative embodiment, as shown in FIG. 5, a recirculating document handler is provided with the same capability of placing two documents in spaced side-by-side relationship at copying positions on platen 27. Recirculating document handlers are used in precollation reproduction machines, to successively feed a plural document set across a copying platen and provide a complete collated set corresponding to each time the document set is fed across the platen. Accordingly, no further sorting of the copy sets is required after the set is produced. In accordance with this embodiment, an embodiment generally similar to that described with respect to FIG. 2, is shown wherein the output means may include a nip roll set 150 to aid in the return of copied documents to document input tray 100 and the top of the original stack. For each set of copies desired, the plural document set is advanced through the document handler a corresponding number of times.

In the present invention, since the documents D in tray 100 are automatically reordered into signature page order as they are fed from tray 100 and imaged on platen 27, the documents fed by belt 116 from platen 27 will be in appropriate signature page order for future circulations through document feeder C. Accordingly, while documents must be fed from tray 100 using both top and bottom feeders 110, 104 the first time the documents are fed into platen 27, each subsequent circulation through feeder C requires that the documents be fed by only one of the feeders (e.g., bottom feeder 104) because the documents are arranged in signature order after their first pass over platen 27. Of course, since documents are being fed selectively by top feeder 110, (for their first pass over platen 27) as earlier fed documents are output by belt 116, these earlier fed documents must be prevented from being immediately placed by nip 150 onto the stack in tray 100 until after the last document is fed for the first time from tray 100. This can be accomplished at least two ways. As shown in FIG. 5, a gate 127, controlled by feed control 102, can be provided to selectively direct documents fed from platen 27 to output tray 126 or to the recirculating document path defined by path 128 and nip 150. The first time documents are passed over platen 27 for producing a first signature copy set, gate 127 is controlled to direct the documents to tray 126. The output stack resulting in tray 126 will be in proper signature page order. Accordingly, the output stack can be removed from tray 126, placed in tray 100, and then fed therefrom using only bottom feeder 104 to produce subsequent signature copy sets. Gate 127 is controlled to direct documents to nip 150, and idler 152 engaged with drive roll 151, and then to the top of the stack in tray 100 during the production of subsequent signature copy sets.

Figure 6A:
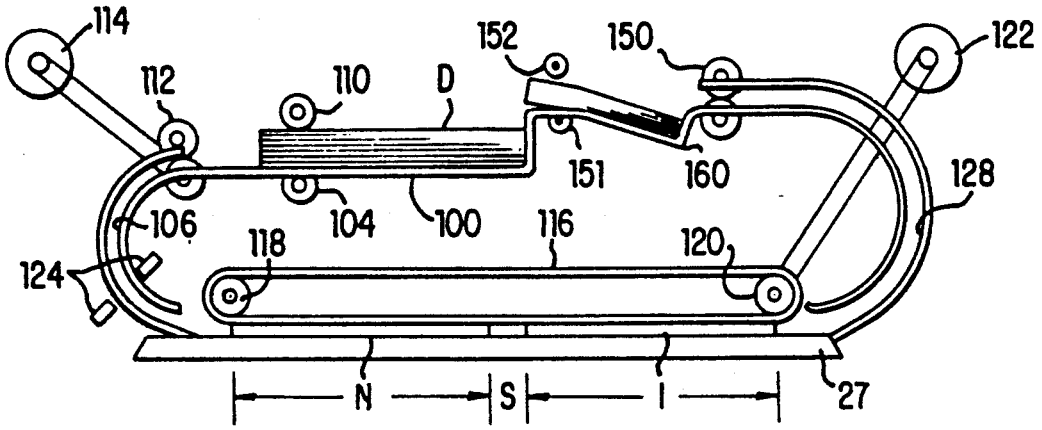
FIGS. 6A-6C are schematic views of another alternative embodiment of the present invention wherein an RDH is used which automatically feeds a stack of signature ordered documents from its output tray to its input tray after making a first signature copy set.
Figure 6B:
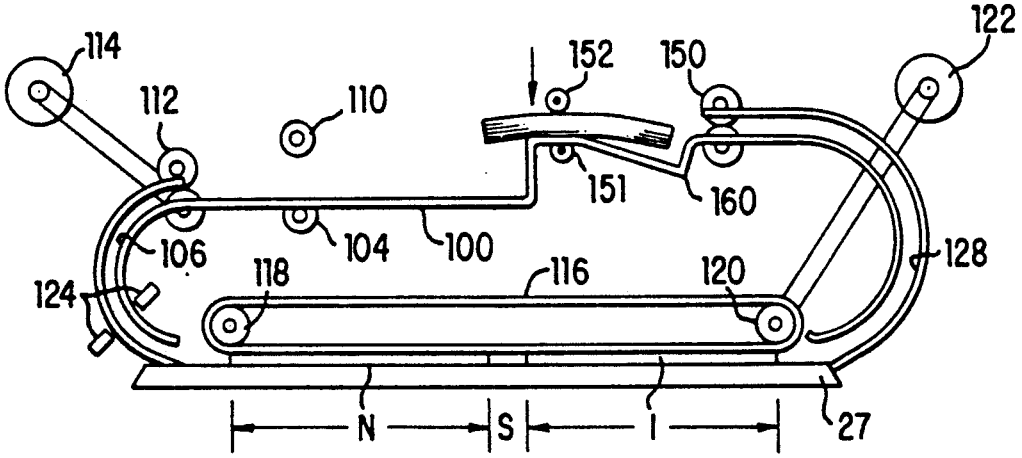
Figure 6C:
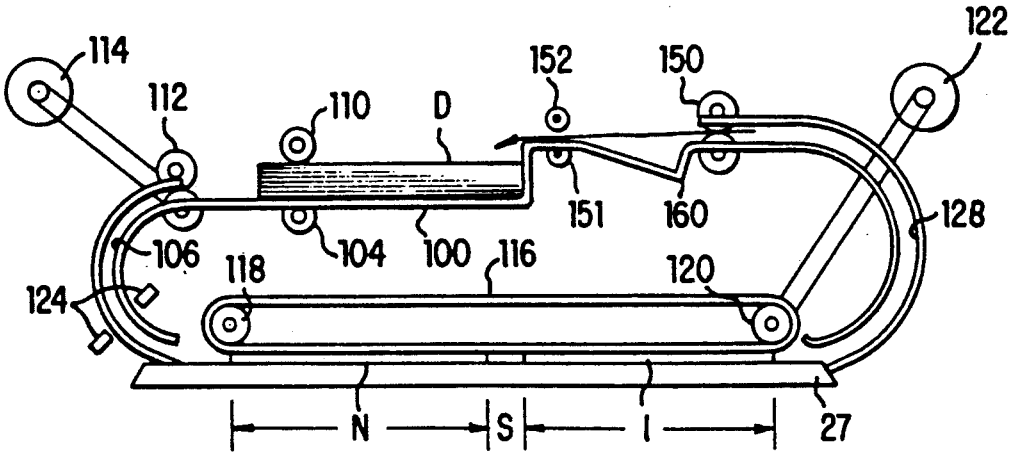

Alternatively, the documents could be collected just downstream of nip 150 to form a stack the first time the documents are imaged, and then the stack could be automatically loaded into tray 100 (after the last document is fed for the first time from tray 100) for subsequent copy sets. FIGS. 6A–6C show one embodiment for permitting the once fed, signature ordered documents to be automatically fed from output tray 160 to tray 100. In this embodiment, output tray 160 is slanted as illustrated in FIGS. 6A–6C so that sheets can be collected in a stack. An output nip is provided by idler 152 and drive roll 151. Idler 152 is selectively movable in the vertical direction so as to selectively engage drive roll 151. When documents are fed from tray 100 the first time (i.e., in alternating pairs by feeders 104, 110 as described above), idler 152 is positioned spaced away from drive roll 151 so that the sheets accumulate in output tray 160 as shown in FIG. 6A. When the entire stack of documents in tray 100 is fed therefrom; imaged and collected in output tray 160 (so that output tray 160 holds a signature ordered stack of documents), idler 152 is lowered as illustrated by the arrow in FIG. 6B so that the entire stack is moved from output tray 160 to tray 100. As described above, signature copying of subsequent sets proceeds by feeding from tray 100 using only bottom feeder 104. During subsequent copying, idler 152 remains in the lower position so that the documents are fed directly to the top of the stack in tray 100 without being collected in output tray 160 as illustrated in FIG. 6C.

It will be appreciated that recirculating document handlers, such as described in U.S. Pat. No. 4,468,114 to Pels et al. and incorporated by reference herein, for example, are well known in the art of document handling, and may be comprised as described in that reference, and incorporating the described feeding and registration scheme of the present invention.

Alternatively, the system illustrated in FIGS. 1, 2 and 4A–4D can be used to make multiple signature copies with post-collation using duplex path buffer tray 88. For example, after the page 1 and 8 documents are placed on platen 27, multiple copies can be made, with the signature copy sheets containing the page 1 and 8 images being stacked in tray 88. After documents 1 and 8 are fed to output tray 126 and the documents containing images 7 and 2 are placed on platen 27, the one side imaged signature copy sheets are fed from duplex buffer tray 88 to transfer station 50 for receipt of their side two image (pages 7 and 2). The two-side imaged signature copy sheets are then output to a collator for separation into multiple copy sets.

Although this disclosed system example describes a precollation signature collating and copying system which makes only one image of two originals at a time, the system herein can also be incorporated into a "dual flash" system in which two identical copies are made at once, as in U.S. Pat. No. 4,782,363.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. Apparatus for signature printing with an automatic duplexing copier by presenting document sheets to an imaging station of the copier in a signature page order for producing signature copy sheets comprising copies of signature pairs of said document sheets on both sides of said signature copy sheets so that said signature copy sheets can be folded into page order signature sets, comprising:

receiving means for receiving a collated stack of document sheets in sequential serial order; and feeding means for selectively feeding the document sheets from a top and from a bottom of the stack received in said receiving means in accordance with a signature sequence by which a first document is fed from one of the top and the bottom of the stack followed by feeding alternate pairs of documents from the top and from the bottom of the stack, starting with an opposite one of said top and bottom of the stack from said one containing said first document, until all documents are fed from said receiving means, for moving said documents two at a time as a signature document pair in said signature sequence directly from said receiving means to an imaging station.

2. The apparatus of claim 1, further comprising:

output feeding means for feeding the signature document pairs from the imaging station after the documents have been imaged; and an output tray, separate from said receiving means, for receiving the signature document pairs fed by said output feeding means.

3. The apparatus of claim 1, wherein said feeding means feeds the documents directly from said receiving means to the imaging station without rotating the documents.

4. The apparatus of claim 1, wherein said feeding means feeds the documents long-edge-first onto the imaging station.

5. The apparatus of claim 1, wherein said feeding means is an automatic document handler including:

a bottom feeder, located below said receiving means, for feeding a lowermost sheet from the bottom of the document stack;

a top feeder, located above said receiving means, for feeding an uppermost sheet from the top of the document stack; and control means for controlling said bottom feeder and said top feeder to feed the documents in said signature sequence.

6. The apparatus of claim 1, wherein said feeding means determines a compensating number of documents which should be added to the stack received in said receiving means so that a total number of documents in the stack is a multiple of 4, and skips the feeding of said compensating number of documents from the opposite one of said top and bottom of the stack while continuing to move documents fed from the stack to the imaging station as if no documents had been skipped, so that said compensating number of blank pages results at the end of a set of signature copy sheets formed from the stack.

7. Apparatus for signature printing comprising:

an automatic duplexing copier having:

an imaging station where documents are placed and imaged to produce a modulated image signal corresponding to images contained on the documents;

an image receptor for receiving said image signal to form a latent image thereon corresponding to images contained on the documents;

a developer for toner developing the latent image to form a toner image on the image receptor corresponding to images contained on the documents;

a transfer station for transferring the toner image to a copy sheet; and a duplex paper path for conveying signature copy sheets short-edge-first past said transfer station to receive a signature toner image on both sides thereof, said duplex paper path including an inversion station for inverting signature copy sheets having a side one signature image prior to said signature copy sheet being fed to said transfer station to receive a side two signature image; and an automatic document feeder for presenting document sheets to said imaging station in a signature page order for producing the signature copy sheets, said automatic document feeder comprising:

receiving means for receiving a collated stack of document sheets in sequential serial order; and feeding means for selectively feeding the document sheets long-edge-first from a top and from a bottom of the stack received in said receiving means in accordance with a signature sequence by which a first document is fed from one of the top and the bottom of the stack followed by feeding alternate pairs of documents from the top and from the bottom of the stack, starting with an opposite one of said top and bottom of the stack from said one containing said first document, until all documents are fed from said receiving means, for moving said documents two at a time as a signature document pair in said signature sequence directly from said receiving means to the imaging station.

8. The apparatus of claim 7, wherein said automatic document feeder further comprises:

output feeding means for feeding the signature document pairs from the imaging station after the documents have been imaged; and an output tray, separate from said receiving means, for receiving the signature document pairs fed by said output feeding means.

9. The apparatus of claim 7, wherein said feeding means feeds the documents directly from said receiving means to the imaging station without rotating the documents.

10. The apparatus of claim 7, wherein said feeding means is an automatic document handler including:

a bottom feeder, located below said receiving means, for feeding a lowermost sheet from the bottom of the document stack;

a top feeder, located above said receiving means, for feeding an uppermost sheet from the top of the document stack; and control means for controlling said bottom feeder and said top feeder to feed the documents in said signature sequence.

11. The apparatus of claim 10, wherein said automatic document feeder further comprises:

output feeding means for feeding the signature document pairs from the imaging station after the documents have been imaged;

an output tray, separate from said receiving means, for receiving the signature document pairs fed by said output feeding means, said imaged document pairs received in said output tray forming an output stack of uncollated document sheets in said signature page order;

a recirculating document path for receiving the signature document pairs fed by said output feeding means and recirculating said documents back to said receiving means;

a gate for selectively directing the signature document pairs fed by said output feeding means to one of said output tray and said recirculating document path; and wherein said control means also controls said gate and is operable in a multiple signature set copy mode to control said gate to direct said documents to said output tray to produce a first copy set, and when the output stack is placed in said receiving means in said multiple signature set copy mode, to control only one of said top feeder and said bottom feeder to feed the document sheets to said imaging station while controlling said gate to direct said documents to said recirculating document path to produce subsequent copy sets.

12. The apparatus of claim 7, wherein said duplex paper path is buffer-trayless.

13. The apparatus of claim 7, wherein said duplex paper path includes a buffer tray so that said copier is capable of producing multiple uncollated copy sets, and further comprising control means for controlling said copier and said automatic document feeder so that each signature document pair fed to said imaging station by said feeding means is imaged multiple times onto respective multiple signature copy sheets which are temporarily stored in said duplex buffer tray prior to being fed past said transfer station a second time to receive the side two signature image.

14. The apparatus of claim 7, wherein said feeding means determines a compensating number of documents which should be added to the stack received in said receiving means so that a total number of documents in the stack is a multiple of 4, and skips the feeding of said compensating number of documents from the opposite one of said top and bottom of the stack while continuing to move documents fed from the stack to the imaging station as if no documents had been skipped, so that said compensating number of blank pages results at the end of a set of signature copy sheets formed from the stack.

15. A method of signature printing with an automatic duplexing copier by presenting document sheets to an imaging station of the copier in a signature page order for producing signature copy sheets comprising copies of signature pairs of said document sheets on both sides of said signature copy sheets so that said signature copy sheets can be folded into page order signature sets, comprising the steps of:

placing a collated stack of document sheets in sequential serial order into an automatic document feeder having a bottom feeder for feeding a lowermost sheet from the bottom of the document stack and a top feeder for feeding an uppermost sheet from the top of the document stack; and selectively feeding the document sheets from a top and from a bottom of the stack placed in said automatic document feeder in accordance with a signature sequence by feeding first document from one of the top and the bottom of the stack followed by feeding alternate pairs of documents from the top and from the bottom of the stack, starting with an opposite one of said top and bottom of the stack from said one containing said first document, until all documents are fed to the imaging station by the automatic document feeder, said documents being moved to said imaging station two at a time as a signature document pair in said signature sequence directly from said automatic document feeder to the imaging station.

16. The method of claim 15, further comprising:

feeding the signature document pairs from the imaging station after the documents have been imaged to an output tray.

17. The method of claim 15, wherein the documents are fed directly by said automatic document feeder to the imaging station without rotating the documents.

18. The method of claim 15, wherein the documents are fed long-edge-first onto the imaging station.

19. The method of claim 18, wherein the signature copy sheets are fed through the copier short-edge-first.

20. The method of claim 15, wherein the signature copy sheets are fed through the copier short-edge-first.

21. The method of claim 15, wherein the automatic document feeder includes:

an output feeding means for feeding the signature document pairs from the imaging station after the documents have been imaged;

an output tray for receiving the signature document pairs fed by said output feeding means, said imaged document pairs received in said output tray forming an output stack of uncollated document sheets in said signature page order;

a recirculating document path for receiving the signature document pairs fed by said output feeding means and recirculating said documents back to an input tray of said automatic document feeder; and a gate for selectively directing the signature document pairs fed by said output feeding means to one of said output tray and said recirculating document path; and wherein said method further comprises controlling said gate in a multiple signature set copy mode to direct said documents to said output tray to produce a first copy set, and when the output stack is placed in said input tray in said multiple signature set copy mode, controlling only one of said top feeder and said bottom feeder to feed the document sheets to said imaging station while controlling said gate to direct said documents to said recirculating document path to produce subsequent copy sets.

22. The method of claim 15, further comprising imaging each signature document pair multiple times at the imaging station to make multiple duplicate signature copy sheets.

23. The method of claim 15, further comprising:

prior to selectively feeding, determining a compensating number of documents which should be added to the stack placed in the automatic document feeder so that a total number of documents in the stack is a multiple of 4, and wherein said selective feeding includes skipping the feeding of said compensating number of documents from the opposite one of said top and bottom of the stack while continuing to move documents fed from the stack to the imaging station as if no documents had been skipped, so that said compensating number of blank pages result at the end of a set of signature copy sheets formed from the stack.

* * * * *